US006418668B1

(12) United States Patent
Arquevaux

(10) Patent No.: US 6,418,668 B1
(45) Date of Patent: Jul. 16, 2002

(54) VEHICLE DOOR WINDOW-LIFT WITH AUTOMATIC FIXING TO THE WINDOW SLIDER SUPPORTING THE WINDOW

(75) Inventor: Laurent Arquevaux, Sully-sur-Loire (FR)

(73) Assignee: Meritor Light Vehicle Systems - France (FR)

( * ) Notice: Subject to any disclaimer, the term of this patent is extended or adjusted under 35 U.S.C. 154(b) by 0 days.

(21) Appl. No.: 09/720,846

(22) PCT Filed: Jun. 30, 1999

(86) PCT No.: PCT/FR99/01578

§ 371 (c)(1),
(2), (4) Date: Dec. 29, 2000

(87) PCT Pub. No.: WO00/01910

PCT Pub. Date: Jan. 13, 2000

(30) Foreign Application Priority Data

Jul. 1, 1998 (FR) ..... 98 08422

(51) Int. Cl.[7] ..... E05F 11/48; E05F 11/38
(52) U.S. Cl. ..... 49/352; 49/348; 49/375
(58) Field of Search ..... 49/352, 348, 349, 49/375, 372

(56) References Cited

U.S. PATENT DOCUMENTS 1,085,877 A * 2/1914 Rheims et al. ..... 49/210
1,406,142 A * 2/1922 Asbury ..... 49/352
1,801,115 A * 4/1931 Semisch ..... 49/63
1,945,821 A * 2/1934 Nicholson ..... 49/280
4,095,370 A * 6/1978 Muehling ..... 49/352
4,730,414 A * 3/1988 Nakamura et al. ..... 49/348
5,058,322 A * 10/1991 Sambor ..... 49/352
5,515,651 A * 5/1996 Hofmann et al. ..... 49/375
5,546,704 A * 8/1996 Maruoka ..... 49/375
5,622,005 A * 4/1997 Ochenski et al. ..... 49/375
5,692,273 A * 12/1997 Rodde ..... 24/541
5,848,496 A * 12/1998 Bertolini et al. ..... 49/352
5,992,099 A * 11/1999 Thomas ..... 49/375
6,131,339 A * 10/2000 Ramus ..... 49/375
6,152,636 A * 11/2000 Nass ..... 403/13
6,205,711 B1 * 3/2001 Klippert ..... 49/375

FOREIGN PATENT DOCUMENTS

DE 4440170 5/1996

* cited by examiner

*Primary Examiner*—Gregory J. Strimbu
(74) *Attorney, Agent, or Firm*—Carlson Gaskey & Olds

(57) ABSTRACT

A vehicle door window-lift comprises a guide rail for a slider supporting a window capable of being driven by a cable and a dowel pin for automatically fixing the slider on the window. The dowel pin is adapted to slide in a bore in the slider and in a hole in the window. Two ramps on the guide rail cause the dowel pin to slide automatically from a delivery position wherein it is not inserted in the hole, into an operative position wherein it penetrates in the window hole and locks the slider on the window. The two ramps are inclined relative to an axis of the dowel pin such that when the slider moves along the rail, the slider causes the dowel pin to be thrust by one of the ramps from its delivery position towards its operative position wherein it penetrates into the window hole and locks the slider on the window. The arrangement avoids providing locking by deformation of a plastic part.

12 Claims, 3 Drawing Sheets

VEHICLE DOOR WINDOW-LIFT WITH AUTOMATIC FIXING TO THE WINDOW SLIDER SUPPORTING THE WINDOW

BACKGROUND OF THE INVENTION

The subject of the present invention is a vehicle door window lifter of the type comprising a rail for guiding a runner that supports the window which can be driven along by a cable and means for fixing the runner to the window.

Systems for automatically positioning a window by "clipping" for window lifters of the cable and drum type are known, these systems being based on the "clipping" of a peg fixed to the window into the runner, or of a plastic tab forming part of the runner into a hole in the window. These devices entail deforming a plastic part to make the connection with the window, and this is not entirely satisfactory.

The object of the invention is to propose a device for fixing the runner to the window which avoids having to deform a plastic part and to operate in the door.

SUMMARY OF THE INVENTION

According to the invention, the means for attaching the runner to the window comprise a pin designed to be able to slide transversely in a bore of the runner and in a hole in the window, and means for causing the pin to slide automatically from a first delivery position in which it is not introduced into the hole, into a position of use in which it enters the hole in the window and locks the runner to the window.

This automatic movement of the pin from its delivery position to its delivery position to its position of use or operation takes place the first time the window lifter is operated.

According to one embodiment of the invention, the means for causing the pin to slide comprise at least one ramp which is inclined with respect to the pin and to its direction of sliding, formed on the guide rail so that movement of the runner along the rail causes the ramp to push the pin from its delivery position into its position of use.

The inclination and length of the ramp are tailored so that the sliding of one end of the pin from one end of the ramp to the other causes the pin to move in translational movement over the travel that corresponds to moving from one position to the other.

Thus, this solution avoids any deforming of plastic parts by instead employing a simple translational movement of one part which may be made of metal.

BRIEF DESCRIPTION OF THE DRAWINGS

Other features and advantages of the invention will become apparent in the course of the description which will follow, which is given with reference to the appended drawings which illustrate one embodiment thereof by way of non-limiting example.

DETAILED DESCRIPTION OF THE PREFERRED EMBODIMENT

Figure 1:
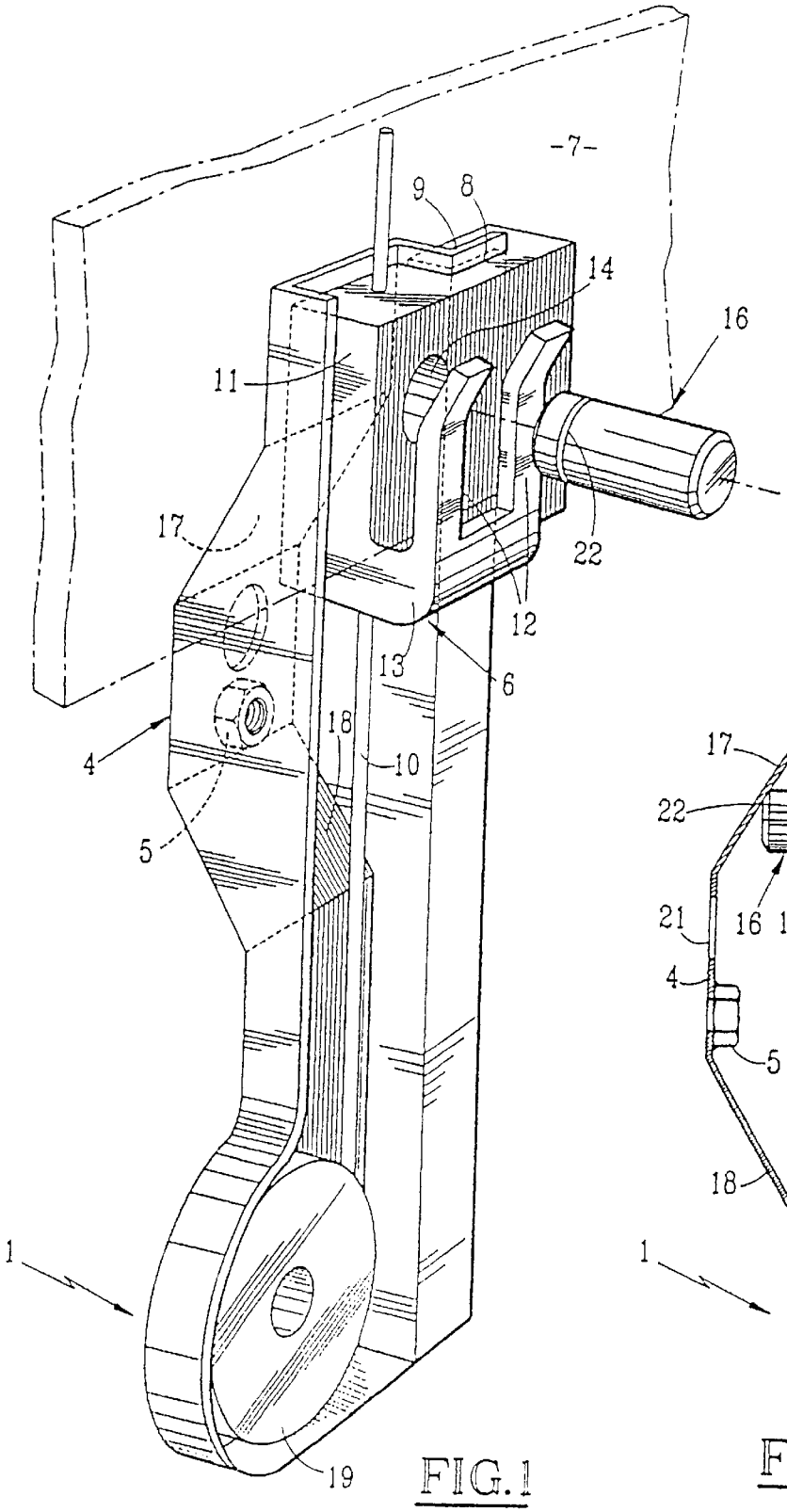
FIG. 1 is a perspective view of a window lifter device, the guide rail and runner of which are arranged according to one embodiment of the invention.

The vehicle door window lifter partially depicted in the drawings comprises a rail 1 forming part of a functional equipment module placed inside a vehicle door frame 2 (FIG. 3) to which it is fixed in a way known per se, for example by bolts 3 passing through pressed zones 4 of the rail 1 and associated with nuts 5.

The window lifter also comprises a runner 6 that supports the window 7 that can be driven along by a cable 10 and which has a profiled slot 8 into which a mating part 9 of the rail 1 can be introduced and on which the runner 6 can thus slide. In a way known per se, the runner 6 consists of a body 11 in which the profiled slot 8 is arranged together with two tabs 12 projecting laterally from the body 11 and an appropriate distance apart, the bottom of the window 7 being positioned between the tabs 12 and the body 11, resting on the connection 13.

Figure 4:
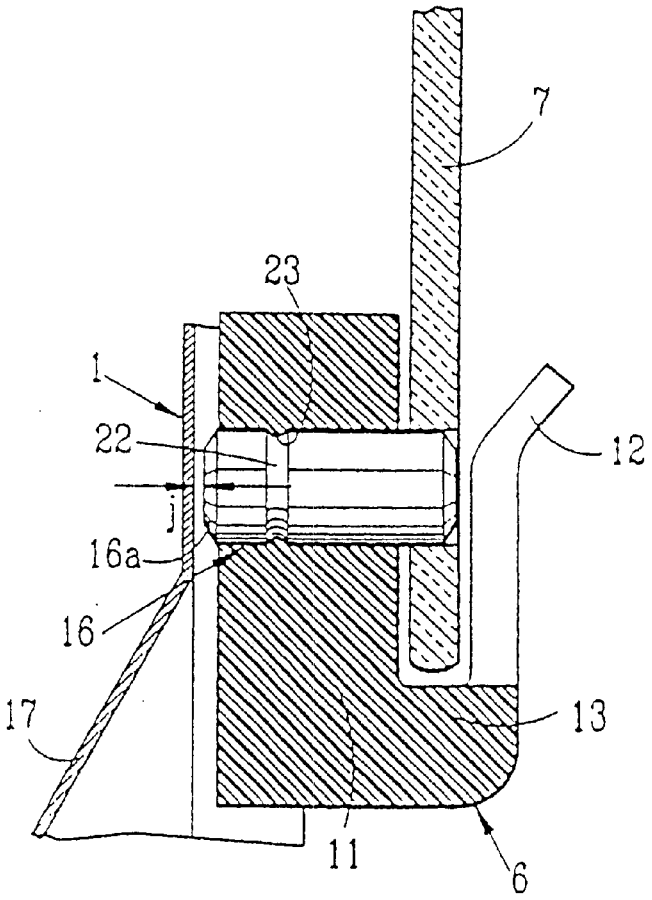
FIG. 4 is a partial elevation view similar to FIG. 2 showing the pin in the position for locking the runner to the rail.

A bore 14 formed transverse to the body 11 faces a corresponding hole 15 arranged in the window 7. The bore 14 and the slot 8 are laterally offset so that the bore 14 cannot open into the slot 8. The runner 6 is equipped with pin 16 which can slide in the bore 14 and in the hole 15 in the window 7, so as to move from a first delivery position depicted in FIG. 2, in which the pin 16 does not enter the hole 15 in the window 7, into a second position of use (visible in FIG. 4) in which the tip of the pin 16 is introduce into the hole 15 in the window 7.

Figure 2:
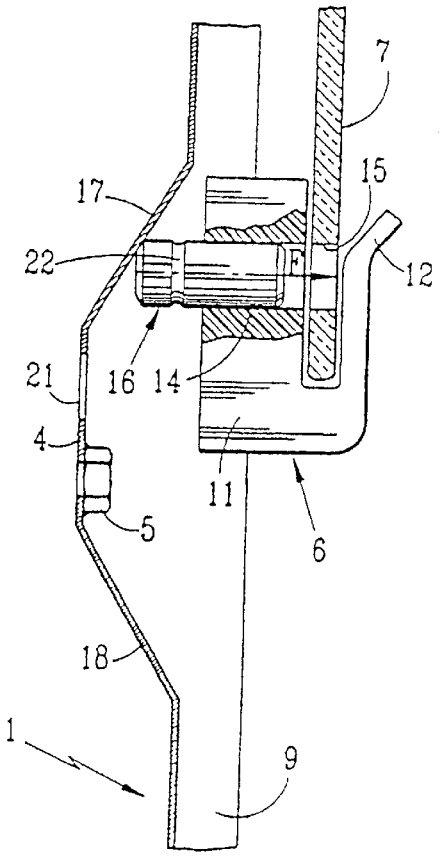
FIG. 2 is a view in partial vertical longitudinal section of the window lifter device of FIG. 1, showing the runner locking pin in its delivery position prior to locking.

In the embodiment depicted, the means for causing the pin 16 to slide automatically from its first position into its second position comprise two ramps 17, 18 which are inclined with respect to the direction F of pin sliding. The ramps 17, 18 are arranged respectively on each side of the pressed part 4, itself arranged in the lower zone of the rail 1 just above a return pulley 19 for the cable 10. The ramps 17, 18 are symmetric with respect to the pressed part 4, the upper ramp 17 having an upwards inclination and the lower ramp 18 having a downwards inclination so that it constitutes a divergent profile widening towards the runner 6. The lengths and inclinations of the ramps 17, 18 are tailored so that when the end of the pin 16 furthers from the hole 15 in the window 7 is practically in contact with the bottom of the ramp 17 (or the top of the lower ramp 18) in the delivery position, movement of the runner 6, driven along by the cable 10, either upwards or downwards, automatically causes the end of the pin 16 to slide along the ramp 17 or 18 and therefore to slide in the direction F in the bore 14. At the end of the sliding movement of the pin 16 along the ramp 17 or 18 (FIG. 4), the pin 16 has entered the hole 15 in the window 7 and thus locked the runner 6 to the window 8. In its delivery position, the pin 16 projects out of the bore 14 towards the ramps 17 and 18 further than is illustrated in FIG. 2.

In order to allow the pin 16 to be expelled if necessary between the two tabs 12, these are laterally offset on the runner 6, on each side of the bore 14. The pin 16 may be introduced into the runner 6 by means of a hole 21 made in the pressed part 4, for example between the nut 5 and the upper ramp 17.

Means for snap-fastening the pin 16 onto the runner 6 in its position of use are also advantageously provided. In the embodiment depicted, these snap-fastening means comprise a groove 22 formed on the periphery of the pin 16 near its opposite end to the hole 15 in the window 7, and a complementary annular boss 23 on the runner 6, projecting into the bore 14. The boss 23 and the groove 22 are positioned in such a way that the arrival of the pin 16 in the position for locking the runner 6 to the window 7 (FIG. 4) is accompanied by the snap-fitting of the boss 23 into the groove 22. After this snap-fitting operation, a clearance j remains between the end face 16*a* of the pin 16 and the closed end of the rail 1. Thus, after the runner 6 has automatically been locked to the window 7, this arrangement prevent the end 16*a* of the pin 16 from rubbing on the rail 1.

Figure 5:
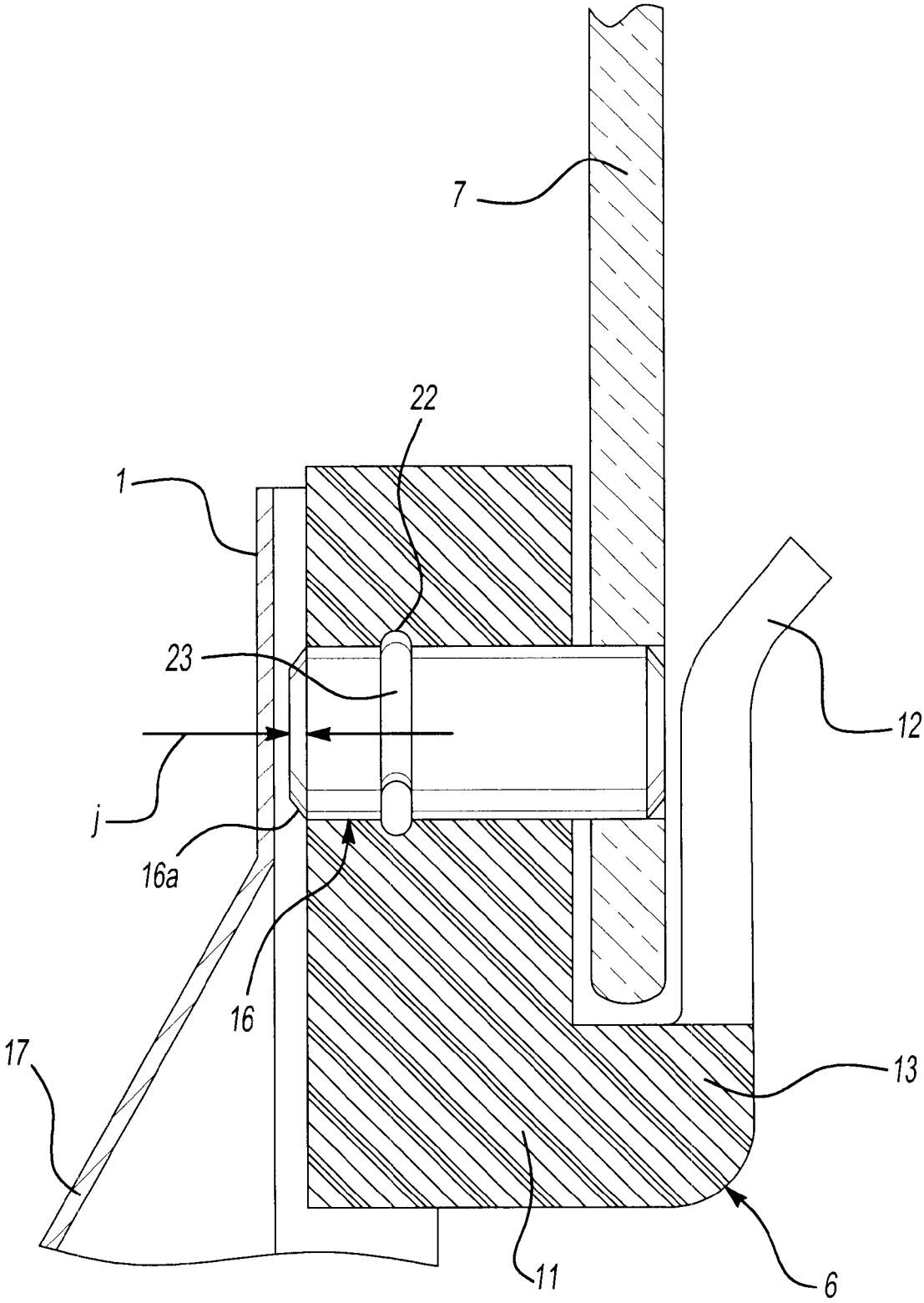
FIG. 5 is another partial elevation view similar to FIG. 2 showing the pin in the position for locking the runner to the rail.

Of course, as an alternative, as shown in FIG. 5, the groove 22 could be formed in the runner 6 and, conversely, the boss 23 could be formed on the pin 16.

It will be understood that a first operation of the window lifter when it enters service, entailing the runner 6 travelling along the rail 1, preferably upwards, automatically causes the pin 16 to slide from its delivery position into its operating position as soon as its end 16*a* comes into contact with the interior face of the ramp 17 (or 18).

Figure 3:
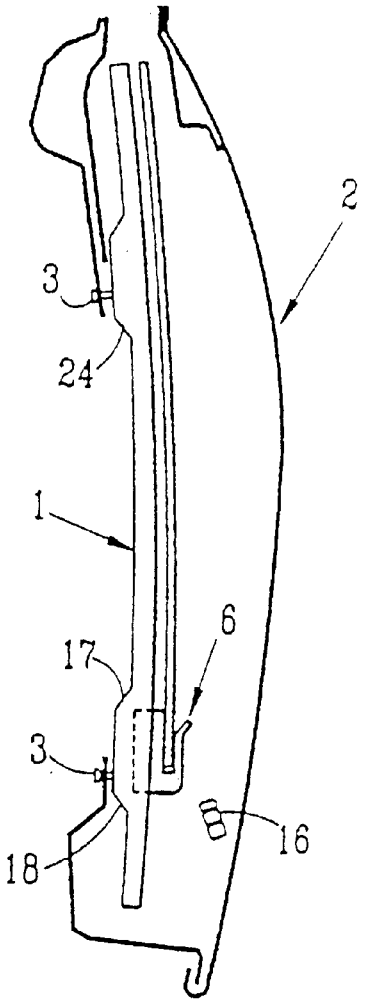
FIG. 3 is a simplified side elevation view of the runner guide rail of FIGS. 1 and 2, arranged in a vehicle door frame.

These ramps 17, 18 may be arranged in zones of the rail 1 other than its lower part, for example in a pressed housing formed in the central zone of the rail 1, or alternatively in its pressed portion 24 located at its upper part (FIG. 3).

The invention is particularly attractive for sealed door modules, because it is not possible for operators to get their hand in after these have been mounted on the door. Thus, if, after assembly, the operator wishes to carry out an operation inside the door, he has no alternative other than to make a hole in the support plate then plug it again afterwards. The invention avoids having to carry out such an operation, any intervention inside the door once the sealed module has been fitted becoming practically needless because simply pulling on the cable automatically causes the pin 16 to slide on the ramp 17 or 18 and become introduced into the window 7, without additional adjustment or correction being needed later.

If there is the desire to detach the window 7 from the runner 6 after the window lifter has been fitted, all that is required is for the runner 6 to be placed on the rail 1 in such a way that its pin 16 is exactly opposite the hole 21. The operator then uses an appropriate tool to push against the end 16*a* of the pin 16, which can be driven without difficulty out of the runner 6, between the tabs 12 (FIG. 3). Such an operation may prove necessary in the context of after-sales service.

The invention can be varied in various ways; thus, just one ramp 17 or 18 produced at any point whatsoever along the rail 1 would be sufficient to allow the pin 16 to be moved.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A vehicle door window lifter comprising:

a rail;

a window including a hole;

a runner guided by said rail to support said window, said runner including a bore aligned with said hole;

a pin which is slidable in said aligned bore and said hole in a direction transverse to a direction of movement of said runner, said pin slidable from a delivery position in which said pin is not in said hole to a position of use in which said pin enters said hole to attach said runner to said window; and at least one ramp formed on said rail, said at least one ramp being inclined with respect to said direction of sliding of said pin, movement of said runner along said rail causes said ramp to push said pin from said delivery position to said position of use.

2. The window lifter as recited in claim 1 wherein said at least one ramp is a pair of ramps, and a pressed zone is positioned between said pair of ramps which are each inclined towards a respective a top and a bottom of said rail, said pin sliding from said delivery position to said position of use as said pin slidably engages one of said pair of ramps as runner moves upwards or downwards with respect to said pressed zone.

3. The window lifter as recited in claim 1 wherein said rail further includes a hole positioned proximate to said at least one ramp for introducing and expelling said pin.

4. The window lifter as recited in claim 1 wherein said pin is snap-fastened onto said runner when said pin is positioned in said position of use.

5. The window lifter as recited in claim 4 wherein a groove on said pin and a complementary boss on said runner provide said snap fastening.

6. The window lifter as recited in claim 4 wherein a groove on said runner and a complementary boss on said pin provide said snap fastening.

7. A vehicle door comprising:

a window lifter including a rail, a window including a hole, a runner guided by said rail to support said window, said runner including a bore aligned with said hole, a pin which is slidable in said aligned bore and said hole in a direction transverse to a direction of movement of said runner, said pin slidable from a delivery position in which said pin is not in said hole to a position of use in which said pin enters said hole to attach said runner to said window; and at least one ramp formed on said rail, said at least one ramp being inclined with respect to said direction of sliding of said pin, movement of said runner along said rail causes said ramp to push said pin from said delivery position to said position of use.

8. The vehicle door as recited in claim 7 wherein said at least one ramp is a pair of ramps, and a pressed zone is positioned between said pair of ramps which are each inclined towards a respective a top and a bottom of said rail, said pin sliding from said delivery position to said position of use as said pin slidably engages one of said pair of ramps as said runner moves upwards or downwards with respect to said pressed zone.

9. The vehicle door as recited in claim 7 wherein said rail further includes a hole positioned proximate to said at least one ramp for introducing and expelling said pin.

10. The vehicle door as recited in claim 7 wherein said pin is snap-fastened onto said runner when said pin is positioned in said position of use.

11. The vehicle door as recited in claim 10 wherein a groove on said pin and a complementary boss on said runner provide said snap fastening.

12. The vehicle door as recited in claim 10 wherein a groove on said runner a complementary boss on said pin provide said snap fastening.

* * * * *

UNITED STATES PATENT AND TRADEMARK OFFICE

CERTIFICATE OF CORRECTION

PATENT NO. : 6,418,668 B1
DATED : July 16, 2002
INVENTOR(S) : Arquevaux

It is certified that error appears in the above-identified patent and that said Letters Patent is hereby corrected as shown below:

Column 4,
Line 17, “a top and a bottom” should be -- top and bottom --
Line 19, add -- said -- between “as” and “runner”
Line 50, “a top and a bottom” should be -- top and bottom --
Line 64, add -- and -- between “runner” and “a”

Signed and Sealed this

Twenty-sixth Day of November, 2002

*Attest:*

*Attesting Officer*

JAMES E. ROGAN
*Director of the United States Patent and Trademark Office*